US008029369B2

(12) United States Patent
Hahn

(10) Patent No.: US 8,029,369 B2
(45) Date of Patent: Oct. 4, 2011

(54) CHAIR INTERCONNECTION FOR A GAMING MACHINE

(75) Inventor: Brian Hahn, Gilbert, AZ (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 11/569,689

(22) PCT Filed: May 26, 2005

(86) PCT No.: PCT/US2005/018681

§ 371 (c)(1),
(2), (4) Date: Oct. 3, 2007

(87) PCT Pub. No.: WO2005/117649

PCT Pub. Date: Dec. 15, 2005

(65) Prior Publication Data

US 2008/0039215 A1 Feb. 14, 2008

Related U.S. Application Data

(60) Provisional application No. 60/640,350, filed on Dec. 30, 2004, provisional application No. 60/575,604, filed on May 28, 2004, provisional application No. 60/575,605, filed on May 28, 2004, provisional application No. 60/575,153, filed on May 28, 2004.

(51) Int. Cl.
*A63F 13/08* (2006.01)
*A47B 83/00* (2006.01)
*A47C 7/62* (2006.01)

(52) U.S. Cl. ..... 463/47; 463/46; 297/172; 297/217.3; 297/463.1

(58) Field of Classification Search ..... 403/321, 403/323, 324, 325, 327, 116, 187, 241, 263, 403/384; 248/503, 503.1; 297/217.1, 217.3, 172, 463.1, 67, 440.6; 411/347; 267/136; 273/148 B; 70/117, 182; 463/36, 37, 46, 47; 296/65.03, 65.07, 65.09; 292/70, 71, 74, 75

See application file for complete search history.

(56) References Cited

U.S. PATENT DOCUMENTS 2,689,016 A 9/1954 Lang
4,413,198 A 11/1983 Bost
4,549,631 A 10/1985 Bose (Continued)

FOREIGN PATENT DOCUMENTS

JP 5031254 2/1993

(Continued)

OTHER PUBLICATIONS

"International Search Report for Application No. PCT/US2005/018681, date mailed Oct. 24, 2005", 4 pgs.

(Continued)

*Primary Examiner* — David L Lewis
*Assistant Examiner* — Matthew D. Hoel
(74) *Attorney, Agent, or Firm* — Schwegman, Lundberg & Woessner, P.A.

(57) ABSTRACT

A gaming system including a chair having a base and a mechanical connector mounted to the base, and a gaming machine having a rotary locking mechanism to mate with the mechanical connector of the chair to latch the base to the gaming machine. The gaming machine and base can include an electrical connection.

20 Claims, 9 Drawing Sheets

U.S. PATENT DOCUMENTS 4,660,833 A 4/1987 Dickinson et al.
4,664,456 A 5/1987 Blair et al.
4,705,274 A 11/1987 Lubeck
4,805,952 A * 2/1989 Coleman ..... 296/65.03
4,840,343 A * 6/1989 Gasser ..... 248/500
4,875,546 A 10/1989 Krnan
4,887,298 A 12/1989 Haigler
5,052,685 A 10/1991 Lowe et al.
5,083,738 A * 1/1992 Infanti ..... 248/500
5,102,192 A 4/1992 Barile
5,114,112 A * 5/1992 Infanti ..... 248/500
5,232,191 A * 8/1993 Infanti ..... 248/500
5,290,034 A 3/1994 Hineman
5,344,331 A 9/1994 Hoffman et al.
5,398,992 A 3/1995 Daniels
5,409,296 A 4/1995 Barile
5,437,453 A 8/1995 Hineman
5,522,641 A * 6/1996 Infanti ..... 297/344.13
5,542,748 A * 8/1996 Barile ..... 297/463.1
5,596,647 A 1/1997 Wakai et al.
5,617,331 A 4/1997 Wakai et al.
5,618,178 A 4/1997 Copperman et al.
5,622,511 A * 4/1997 Jarrett ..... 439/248
5,669,818 A 9/1997 Thorner et al.
5,678,886 A * 10/1997 Infanti ..... 297/217.3
5,762,617 A * 6/1998 Infanti ..... 601/49
5,768,724 A 6/1998 Buell
5,791,731 A * 8/1998 Infanti ..... 297/217.3
5,807,177 A * 9/1998 Takemoto et al. ..... 463/47
5,908,354 A 6/1999 Okuniewicz
5,910,991 A 6/1999 Farrar et al.
5,953,429 A 9/1999 Wakai et al.
6,012,755 A * 1/2000 Hecht et al. ..... 296/65.03
6,075,868 A 6/2000 Goldfarb et al.
6,089,663 A 7/2000 Hill
6,135,562 A 10/2000 Infanti
6,161,892 A 12/2000 Chabanne et al.
6,191,892 B1 2/2001 Isaka et al.
6,206,335 B1 * 3/2001 Huber et al. ..... 248/601
6,227,614 B1 5/2001 Rubin
6,290,536 B1 9/2001 Hwang et al.
6,314,330 B1 11/2001 Matthews
6,354,660 B1 * 3/2002 Friedrich ..... 297/217.1
6,368,216 B1 4/2002 Hedrick et al.
6,422,670 B1 7/2002 Hedrick et al.
6,422,941 B1 7/2002 Thorner et al.
6,430,297 B1 8/2002 Nakamura
6,530,842 B1 * 3/2003 Wells et al. ..... 463/46
6,544,200 B1 4/2003 Smith et al.
6,572,187 B2 * 6/2003 Laufer ..... 297/217.1
6,656,041 B1 12/2003 Kaminkow et al.
6,694,034 B2 2/2004 Julstrom et al.
6,752,445 B1 6/2004 Koehler et al.
6,824,419 B1 11/2004 Wu
6,885,899 B1 4/2005 Yoon
7,112,139 B2 9/2006 Paz Barahona et al.
7,114,171 B2 9/2006 Brady, Jr. et al.
7,136,498 B1 11/2006 Schott
7,206,426 B1 4/2007 Julstrom et al.
7,364,508 B2 4/2008 Loose et al.
7,367,886 B2 5/2008 Loose et al.
7,479,063 B2 1/2009 Pryzby et al.
7,522,740 B2 4/2009 Julstrom et al.
7,658,445 B2 2/2010 Mittler et al.
7,688,992 B2 3/2010 Aylward et al.
7,766,747 B2 8/2010 Bonney et al.
7,826,627 B2 11/2010 Radek
7,832,799 B2 11/2010 Davis, Jr.
7,867,085 B2 1/2011 Pryzby et al.
2002/0041069 A1 4/2002 Steelman
2002/0155887 A1 10/2002 Criss-Puszkiewicz et al.
2003/0044033 A1 3/2003 Julstrom et al.
2003/0100359 A1 5/2003 Loose et al.
2003/0122973 A1 7/2003 Huang
2003/0152243 A1 8/2003 Julstrom et al.
2003/0185400 A1 10/2003 Yoshizawa et al.
2004/0007907 A1 1/2004 DiRe
2004/0014514 A1 1/2004 Yacenda
2004/0018867 A1 1/2004 Manz
2004/0142747 A1 7/2004 Pryzby
2004/0161115 A1 8/2004 Loose
2004/0162144 A1 8/2004 Loose et al.
2004/0254020 A1 * 12/2004 Dragusin ..... 463/46
2004/0258270 A1 12/2004 Shima
2005/0053252 A1 3/2005 Cohen
2005/0054442 A1 3/2005 Anderson et al.
2005/0159219 A1 7/2005 Oswald
2005/0164788 A1 7/2005 Grabiec
2005/0239434 A1 10/2005 Marlowe
2006/0064187 A1 3/2006 Nishikori et al.
2006/0068908 A1 3/2006 Pryzby et al.
2006/0068909 A1 3/2006 Pryzby et al.
2006/0072765 A1 4/2006 Shibutani
2006/0073881 A1 4/2006 Pryzby et al.
2006/0100015 A1 5/2006 Loose et al.
2006/0116073 A1 6/2006 Richenstein et al.
2006/0269088 A1 11/2006 Julstrom et al.
2007/0015570 A1 1/2007 Pryzby
2007/0270216 A1 11/2007 Pryzby
2007/0293304 A1 12/2007 Loose et al.
2008/0009347 A1 1/2008 Radek
2008/0054561 A1 3/2008 Canterbury et al.
2008/0064486 A1 3/2008 Pryzby et al.
2008/0070685 A1 3/2008 Pryzby et al.
2008/0096666 A1 4/2008 Pryzby et al.
2008/0111408 A1 5/2008 Duran et al.
2008/0139284 A1 6/2008 Pryzby et al.
2008/0161108 A1 7/2008 Dahl et al.
2008/0176654 A1 7/2008 Loose et al.
2008/0188291 A1 8/2008 Bonney et al.
2008/0194319 A1 8/2008 Pryzby et al.
2008/0211276 A1 9/2008 Rasmussen
2008/0214289 A1 9/2008 Pryzby et al.
2008/0234026 A1 9/2008 Radek
2008/0246321 A1 10/2008 Canterbury
2009/0041257 A1 2/2009 Yoshizawa et al.
2009/0170597 A1 7/2009 Bone
2009/0298579 A1 12/2009 Radek et al.
2010/0029385 A1 2/2010 Garvey et al.
2010/0075750 A1 3/2010 Bleich et al.
2010/0099487 A1 4/2010 Canterbury et al.
2010/0248815 A1 9/2010 Radek
2010/0298051 A1 11/2010 Loose et al.
2010/0317437 A1 12/2010 Berry et al.

FOREIGN PATENT DOCUMENTS

WO WO-2005/117647 A1 12/2005
WO WO-2005/120127 A1 12/2005

OTHER PUBLICATIONS

"Written Opinion of the International Searching Authority for Application No. PCT/US2005/018681, date mailed Oct. 24, 2005", 6 pgs.
"U.S. Appl. No. 11/569,732, Non-Final Office Action mailed Mar. 18, 2009", 16 pgs.
"U.S. Appl. No. 11/569,687, Advisory Action mailed Dec. 21, 2010", 3 pgs.
"U.S. Appl. No. 11/569,687, Final Office Action mailed Aug. 20, 2010", 10 pgs.
"U.S. Appl. No. 11/569,730, Response fiiled Jan. 13, 2011 to Non Final Office Action mailed Oct. 13, 2010", 14 pgs.
"U.S. Appl. No. 11/569,732, Response filed Dec. 10, 2010 to Non-Final Office Action mailed Sep. 10, 2010", 19 pgs.
"U.S. Appl. No. 11/569,687, Non Final Office Action mailed Mar. 31, 2011", 21 pgs.
"U.S. Appl. No. 11/569,732, Final Office Action mailed Mar. 4, 2011", 14 pgs.
"U.S. Appl. No. 11/569,732, Notice of Allowance mailed Mar. 30, 2011", 10 pgs.
"U.S. Appl. No. 11/569,730, Final Office Action mailed Apr. 4, 2011", 7 pgs.
"U.S. Appl. No. 11/569,687 Non-Final Office Action mailed Jan. 27, 2010", 11 pgs.
"U.S. Appl. No. 11/569,687, Response filed May 27, 2010 to Non Final Office Action mailed Jan. 27, 2010", 14 pgs.

"U.S. Appl. No. 11/569,732, Final Office Action mailed Apr. 16, 2010", 12 pgs.
"U.S. Appl. No. 11/569,732, Response filed Sep. 17, 2009 to Non Final Office Action mailed Mar. 18, 2009", 13 pgs.
"U.S. Appl. No. 11/569,732, Restriction Requirement mailed Dec. 29, 2009", 6 pgs.
"U.S. Appl. No. 11/569,732, Examiner Interview Summary Request Sep. 24, 2009", 2 pgs.
"U.S. Appl. No. 11/569,732, Preliminary Amendment filed Nov. 28, 2006", 3 pgs.
"U.S. Appl. No. 11/569,732, Response filed Aug. 16, 2010 to Final Office Action mailed Apr. 16, 2010", 19 pgs.
"U.S. Appl. No. 11/569,732, Response filed Jan. 29, 2010 to Restriction Requirement mailed Dec. 29, 2009", 7 pgs.
"U.S. Appl. No. 11/569,687, Final Office Action mailed Aug. 20, 2010", 10 pgs.
"International Application Serial No. PCT/US05/18392, International Search Report mailed Oct. 26, 2005", 3 pgs.
"International Application Serial No. PCT/US05/18392, Written Opinion mailed Oct. 26, 2005", 8 pgs.
"International Application Serial No. PCT/US05/18475, International Search Report mailed Oct. 21, 2005", 4 pgs.
International Application Serial No. PCT/US05/18475, Written Opinion mailed Oct. 21, 2005, 6 pgs.
"International Application Serial No. PCT/US05/18595, International Search Report mailed Oct. 25, 2005", 2 pgs.
"International Application Serial No. PCT/US05/18595, Written Opinion mailed Oct. 25, 2005", 6 pgs.
"International Application Serial No. PCT/US05/18681, International Search Report mailed Oct. 24, 2005", 3 pgs.
"International Application Serial No. PCT/US05/18681, Written Opinion mailed Oct. 24, 2005", 5 pgs.
"U.S. Appl. No. 11/569,732 Non-Final Office Action mailed Sep. 10, 2010", 12 pgs.
"U.S. Appl. No. 11/569,687, Preliminary Amendment filed Nov. 28, 2006", 3 pgs.
"U.S. Appl. No. 11/569,687, Response filed Nov. 22, 2010 to Final Office Action mailed Aug. 20, 2010", 16 pgs.
"U.S. Appl. No. 11/569,730, Non-Final Office Action mailed Oct. 13, 2010", 14 pgs.

* cited by examiner

CHAIR INTERCONNECTION FOR A GAMING MACHINE

CROSS-REFERENCE TO RELATED APPLICATION

This application is a U.S. National Stage Filing under 35 U.S.C. 371 from International Patent Application Serial No. PCT/US2005/018681, filed May 26, 2005, and published on Dec. 15, 2005 as WO 2005/117649 A1, which claims the benefit under 35 U.S.C. 119 (e) of U.S. Provisional Application No. 60/640,350 filed on Dec. 30, 2004, which applications are hereby incorporated by reference in their entirety. This application is related to U.S. Provisional Patent Application Ser. No. 60/575,604, entitled "SPEAKER SYSTEM FOR A GAMING MACHINE" and is also related to U.S. Provisional Patent Application Ser. No. 60/575,605, entitled "CHAIR INTERCONNECTION FOR A GAMING MACHINE" and is also related to U.S. Provisional Patent Application Ser. No. 60/575,153, entitled "GAMING DEVICE WITH ATTACHED AUDIO-CAPABLE CHAIR", all filed on May 28, 2004, and all of which are hereby incorporated by reference herein for all purposes.

FIELD

The invention relates generally to gaming systems, and more specifically to chair interconnections for gaming systems.

COPYRIGHT

A portion of the disclosure of this patent document may contain material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2005, WMS Gaming, Inc. All Rights Reserved.

BACKGROUND

A wide variety of gaming devices are now available to game players and to gaming establishment operators in computerized form, from slot machines to games that are traditionally played live such as poker and blackjack. Computerized video game systems must provide sufficient feedback to the gamer to make the game fun to play, and they must provide a gaming experience that is at least as attractive as the older mechanical gaming machine experience to the gamer, to ensure success in a competitive gaming market. A chair for a gaming device can be mechanically and electrically coupled to the gaming device via a sled.

SUMMARY

A gaming system including a chair having a base and a mechanical connector mounted to the base, and a gaming machine having a rotary locking mechanism to mate with the mechanical connector of the chair to latch the base to the gaming machine. The gaming machine and base can include an electrical connection.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined or that other embodiments may be utilized and that structural changes may be made without departing from the spirit and scope of the invention. The following detailed description is, therefore, not to be taken in a limiting sense, and the scope of the invention is defined by the appended claims and their equivalents.

Note that in the description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, embodiments of the invention can include any variety of combinations and/or integrations of the embodiments described herein.

As used herein, the term "gaming machine" refers to a machine into which a coin or token is deposited, or which is activated by a card or token associated with data regarding non-monetary chattel, to play a game that uses a video display or an electromechanical device with a spinning reel. The gaming machines include slot machines and push button machines. The gaming machines include coin operated machines and machines having a serial interface. Gaming machines also include gaming tables capable of being initiated by a card or token. Gaming machines can be stand-alone or they can be mounted on a stand. As used herein, gaming machine also refers to the stand for the gaming machine, if one is provided.

Figure 1:
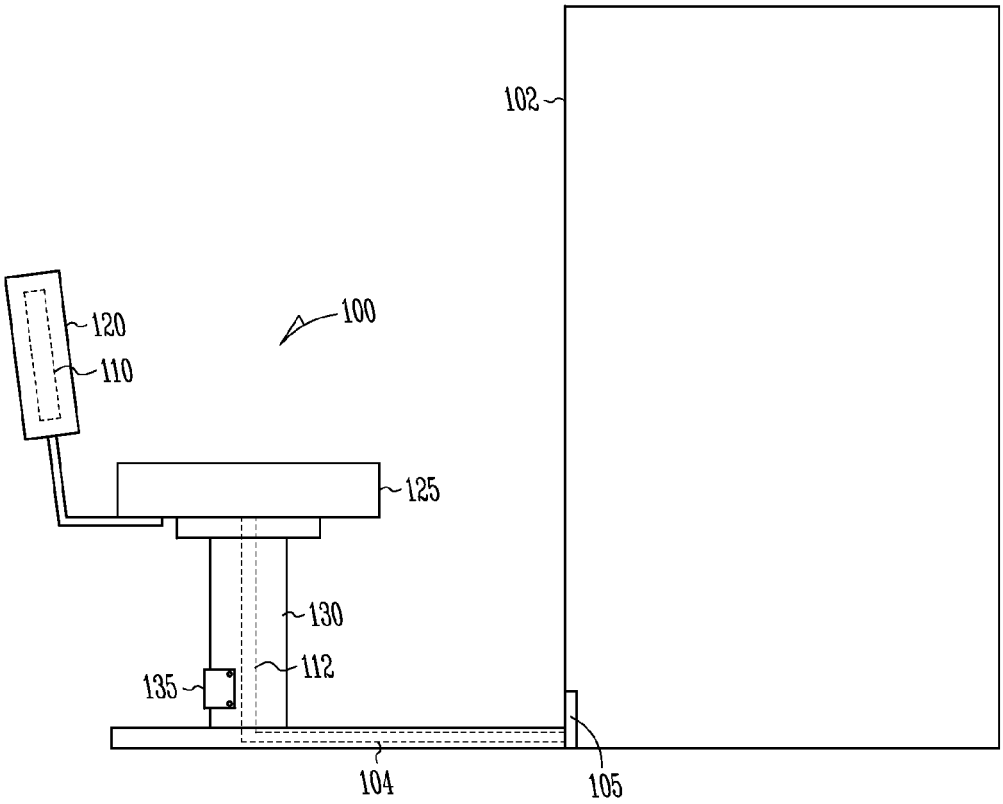
FIG. 1 shows the general environment for a gaming system according to one embodiment.

FIG. 1 shows the general environment for a gaming system according to one embodiment. In this example, the system includes chair 100 electrically and mechanically coupled to a gaming machine 102. Gaming machine 102 can be a gaming machine such as a slot machine, for example. It can be stand-alone or mounted on a stand, for example. In one embodiment, chair 100 is coupled to the gaming machine via a base 104, such as a sled. In some embodiments, the electrical connection between chair 100 and gaming machine 102 is omitted and chair 100 is only mechanically coupled to the gaming machine.

In one embodiment, the system further includes electronics, such as a speaker package 110 incorporated into chair 100 and coupled via an electrical connection 112 to gaming machine 102. Gaming machine 102 includes hardware and software and produces sound signals which are delivered to speaker package 110. Speaker package 110 provides sound effects, game noises, and other audio effects from gaming machine 102. In one example, electrical connection 112 runs through base 104 from machine 102 to speaker package 110 in the chair. In other examples, other electrical signals can be delivered to other types of electronics in the chair, for example video signals or power signals for lights. In other embodiments, the gaming machine includes speakers and the sound signals are delivered to the gaming machine speakers instead of, or in addition to, the chair speakers.

Chair 100 generally includes a back 120 and a seat 125. The chair is swivel mounted to a seat post 130. Seat post 130 is at least partially hollow to allow connection 112 to run through the post. An access panel 135 can be provided in the seat post 130 to allow access to connection 112 to allow a user to connect wires running from speaker package 110 to a electrical connection 107 in base 104. Electrical connection 107 can be a circuit board or a flex cable, for example. Base 104 is removably connectable to gaming machine 102, both mechanically and electrically, at a connection assembly 105 coupled to machine 102. This allows for easier installation and maintenance than a permanent connection. Electrical signals from the machine go to a connector coupled to the cabinet of game machine 102 which mates with a connector on base 104 of the chair.

Figure 2A:
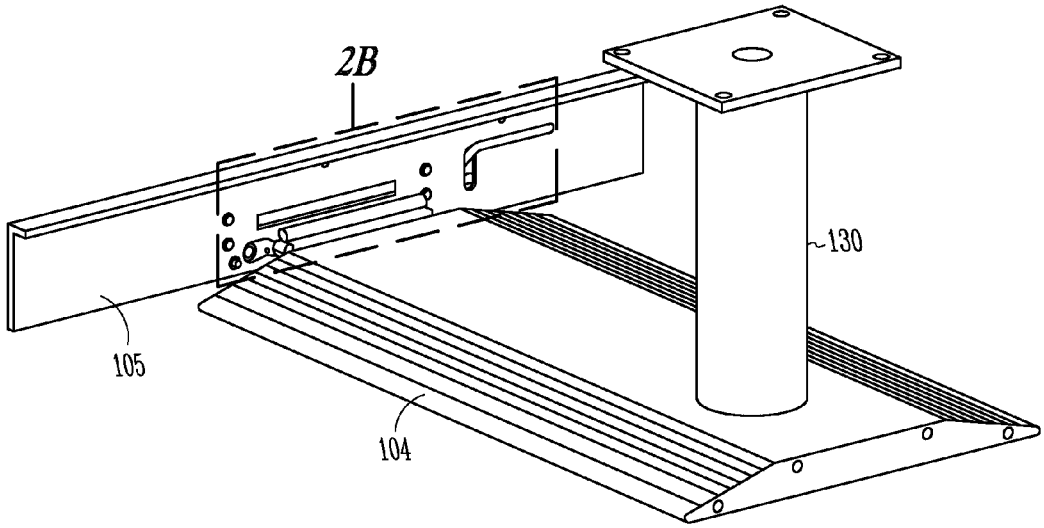
FIG. 2A shows a rear perspective view of a base and gaming machine interconnection system, in accordance with one embodiment.
Figure 2B:
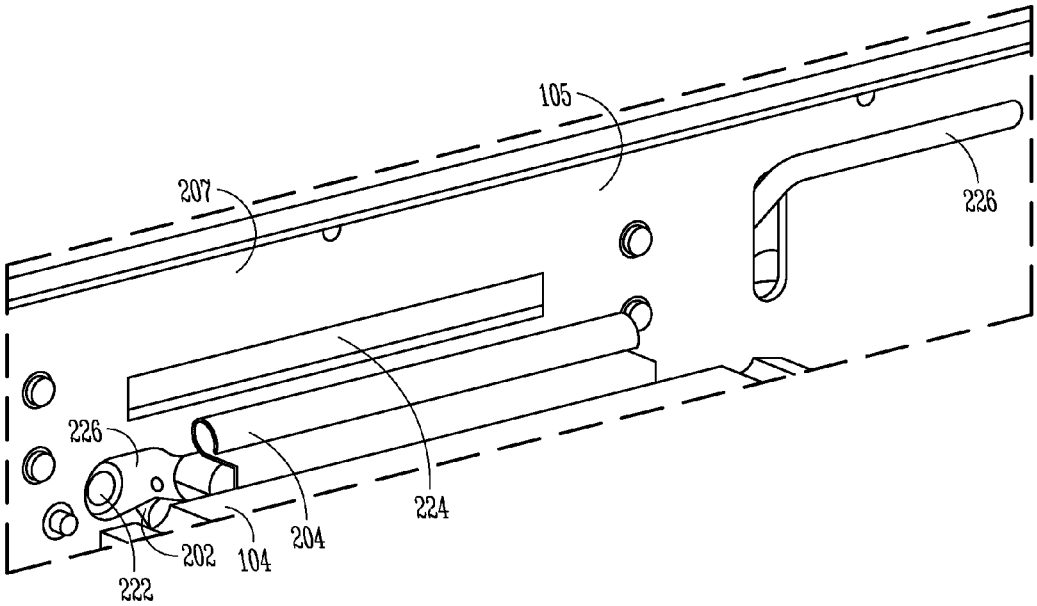
FIG. 2B shows further details of the interconnection system of FIG. 2A.

FIGS. 2A and 2B show a perspective view of base 104 and game machine connection assembly 105, in accordance with one embodiment. Extending from a front end of the base is a guide pin 202 which is for engaging with a guide pin receiver 222 on the gaming machine. A second guide pin and pin receiver are located on the other side of the front end of the sled, but are not shown on FIG. 2B. At the front end of base 104 is a rigidly mounted mechanical coupling member, such as a cross-pin 204. Cross-pin 204 extends outward from the front end of the base and has a longitudinal orientation parallel with the front end of the sled. In one embodiment, cross-pin 204 includes a folded or curled metal piece defining a tubular structure. In other examples, the cross-pin can be a solid member. Cross-pin 204 is located so as to go through a slot opening 224 exposed through a front plate 207 of the connection assembly 105. As will be discussed in further detail below, cross-pin 204 is part of a rotary locking mechanism, in accordance with one embodiment.

After being inserted through opening 224, cross-pin 204 enters a mechanical locking member, such as a tubular locking member which has a cut-away section allowing the cross-pin to enter the interior of the tubular locking member. The tubular locking member is operatively coupled to a removable actuator 226 which is accessible on the front side of the gaming machine. When actuator 226 is inserted and then rotated downward, the tubular locking member rotates and holds cross-pin 204 in place within the interior of the tubular locking member.

Figure 3A:
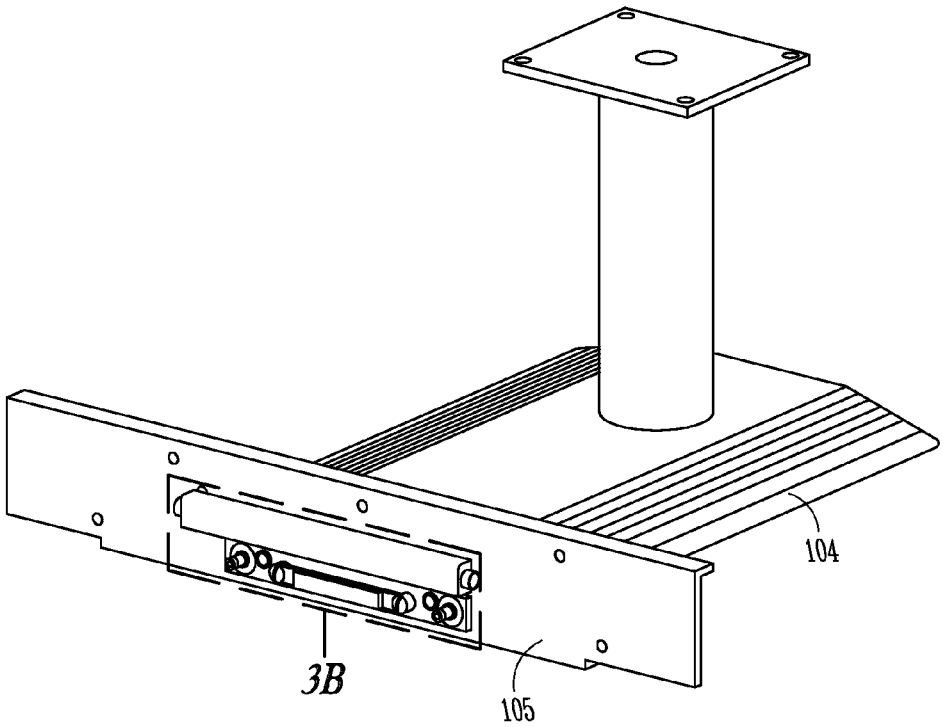
FIG. 3A shows a front perspective view of the interconnection system of FIG. 2.
Figure 3B:
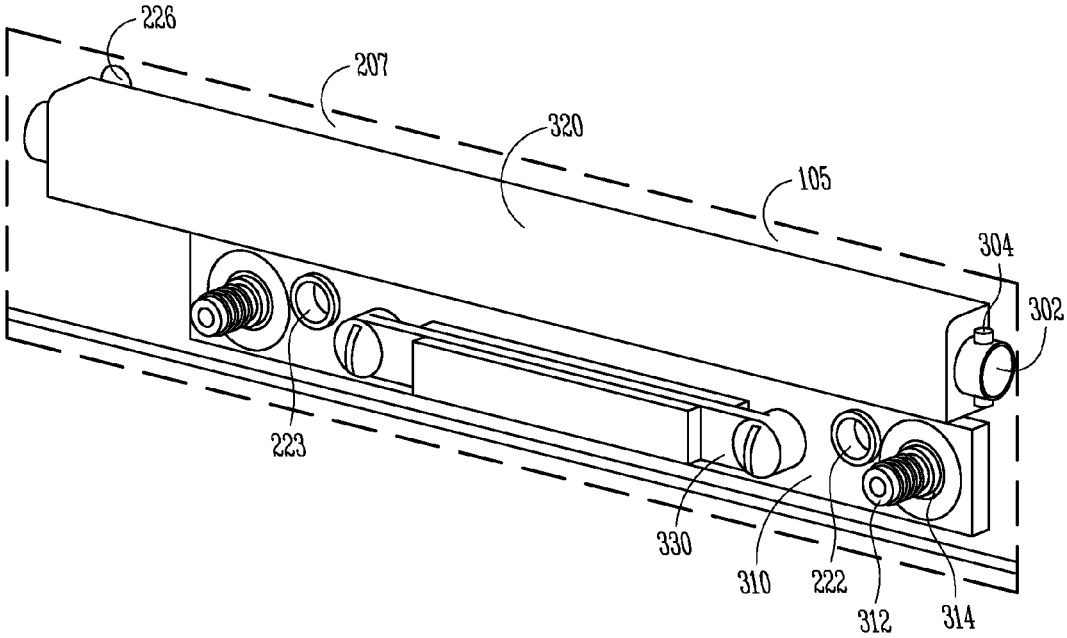
FIG. 3B shows further details of the view of FIG. 3A.

FIGS. 3A and 3B show a rear perspective view of base 104 and connection assembly 105. Mounted to a back side of plate 207 is a housing 320. Located within housing 320 is a mechanical coupling member, such as a tubular locking member 302. In one embodiment, tubular locking member 302 includes ends which protrude from holes at each end of housing 320 and pins 304 hold the tubular member in position. A portion of actuator 226 can be seen extending through front plate 207. Again, as actuator 226 is rotated downward, tubular locking member 302 rotates to encompass and hold cross-pin 204 (FIG. 2B).

In one embodiment, a mounting plate 310 is float-mounted to front plate 207 and is located behind, but not aligned with, opening 224 (FIG. 2B). In this example, both ends of plate 310 are mounted to the front plate by bolts 312 with springs 314 located between a head of the bolt and the plate. The springs 314 allow plate 310 to move back and forth relative to front plate 207. In one example, springs 314 are attached to plate 310 and the holes in the plate for bolts 312 are larger than the bolt diameter. This allows plate 310 to translate left and right, up and down, and diagonally relative to front plate 207. This allows substantial misalignment between the base 104 and the gaming machine and allows for tolerance to mount the electrical connection together. For example, as pins 202 (FIG. 2B) reach receivers 222, they may be off-line by about ¼" about ½" or so depending on the floor surface, for example. As the pins enter the receivers, the spring-loaded plate adapts to the misalignment and can move up/down, left/right, or diagonally, as needed. Moreover, this is a blind-mate connection system and the user does not manually manipulate the interconnection. Accordingly the system automatically adjusts as necessary.

Electrical connector 330 is also mounted to plate 310. In one example, connector 330 is float-mounted to plate 310, allowing for further adjustment between the connector on the sled and connector 330 when the connectors are mated. Thus, as the sled is being pushed toward the gaming machine, plate 310 can adjust depending on the alignment of pins 202 and receivers 222, and then connector 330 can adjust depending on the relative alignment between the sled connector and itself. In some embodiments, the electrical connector 330 is rigidly mounted to plate 310.

Figure 4A:
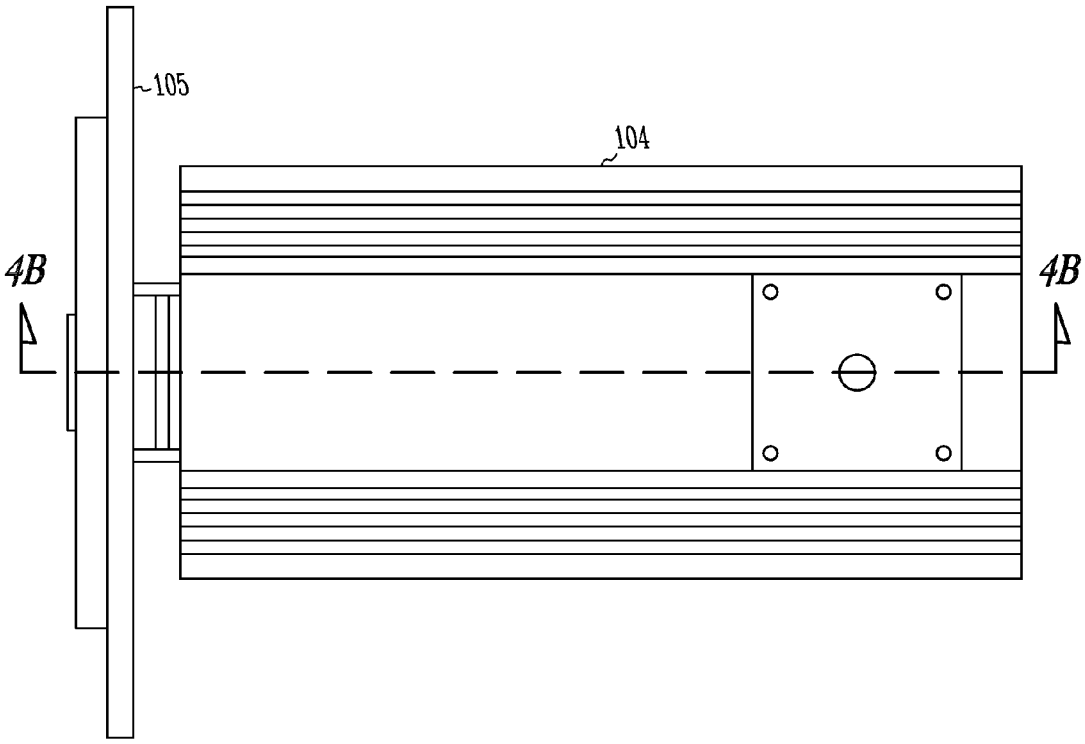
FIG. 4A shows a top view of the interconnection system of FIG. 1.
Figure 4B:
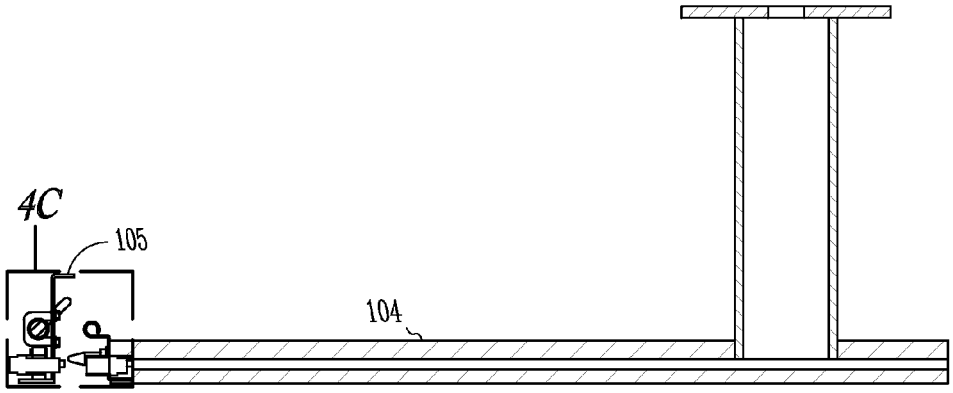
FIG. 4B shows a side section view of FIG. 4A.
Figure 4C:
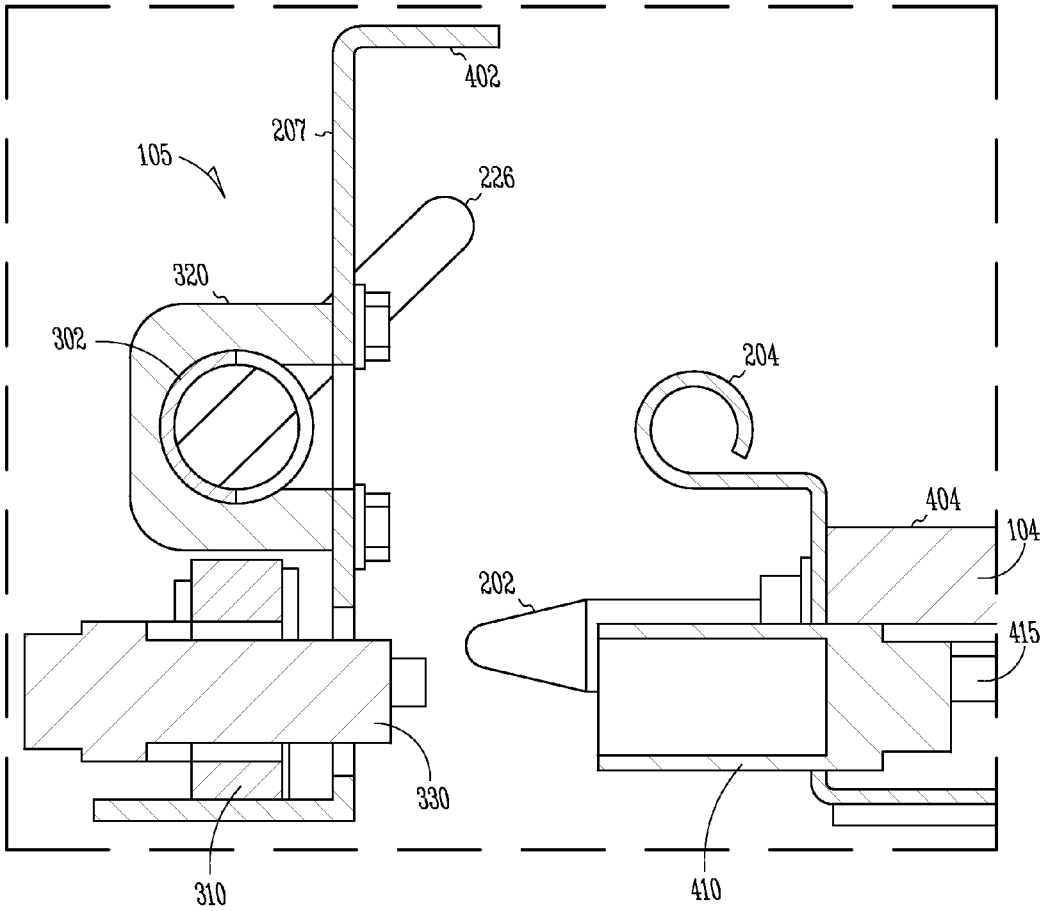
FIG. 4C shows a detail of FIG. 4B.

FIG. 4A shows a top view of the system. FIG. 4B shows a section of FIG. 4A and FIG. 4C shows further details of connection assembly 105. FIG. 4C shows the base 104 separated from connection assembly 105 before being connected. In one embodiment, base 104 includes an electrical connector 410 coupled to a front end of the sled. The electrical connector 410 is exposed on the front end and is located below a top surface 404 of base 104. This helps prevent a user from intentionally or unintentionally accessing the connection. Connector 410 is operatively coupled to the electronic devices in the game seat via electrical connection 415.

In one embodiment, connector 410 on base 104 is a receptacle side of a blind-mate drawer connector. One embodiment uses Tyco Electronics AMP 213974-1, for example. Connector 330 can be a blind-mate drawer style connector from AMP with up to 30 contacts (AMP part number 213973-1), for example. The plug side of connector 330 floats and has alignment guides. Connector 410 can be rigidly fixed to base 104 with the connector mating occurring when the base 104 is moved towards connection assembly 105. Alignment between the base 104 and connection assembly 105 is configured to ensure that the base, and thus the connectors 330, 410 are aligned in the horizontal and vertical direction prior to the connector housings coming into contact with each other, since guiding pin 202 extends farther forward than connector 410. Accordingly, pin 202 is pushed into guiding hole receiver 222 (FIG. 2B) before the connector 410 contacts its mating connector 330. Again, receiver 222 and connector 330 are both located on the spring-loaded plate 310 and thus allow for misalignment to be overcome. Furthermore, connector 330 can be float-mounted to plate 310. In some embodiments, the connector on the base can be float mounted and the connector on the gaming machine is fixed.

As the electrical connection is made between connectors 330 and 410, cross-pin 204 enters tubular locking member 302 and actuator 226 is rotated downward to latch the base 104 to the connection assembly 105. In this embodiment, front plate 207 includes an overhanging lip 402 to help stiffen the plate.

Figure 5A:
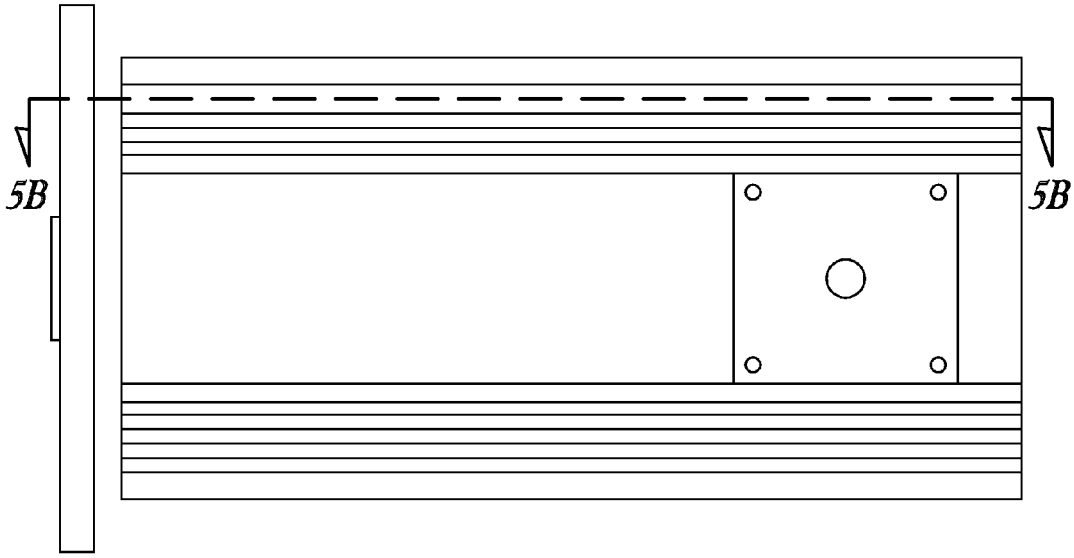
FIG. 5A shows a top view of the interconnection system of FIG. 1.
Figure 5B:
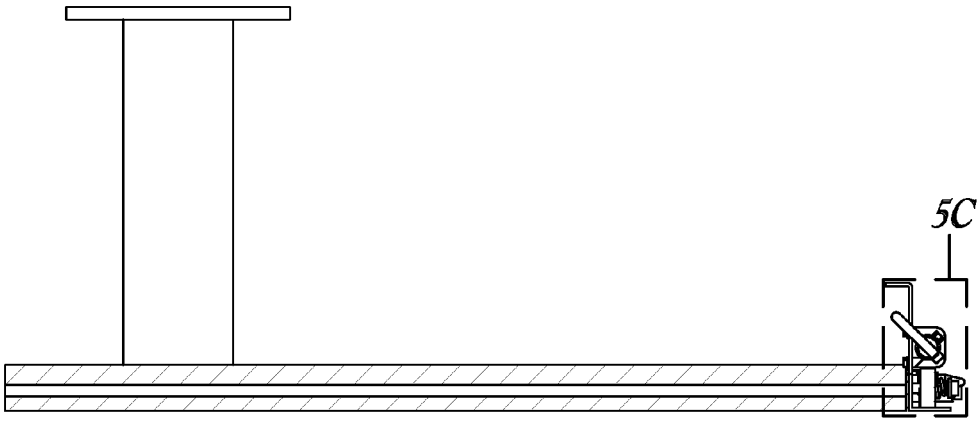
FIG. 5B shows a side section view of FIG. 5A.

FIG. 5A shows a top view of the system. FIG. 5B shows a section of FIG. 5A and FIG. 5C shows further details of connection assembly 105 and base 104, in accordance with one embodiment.

Figure 5C:
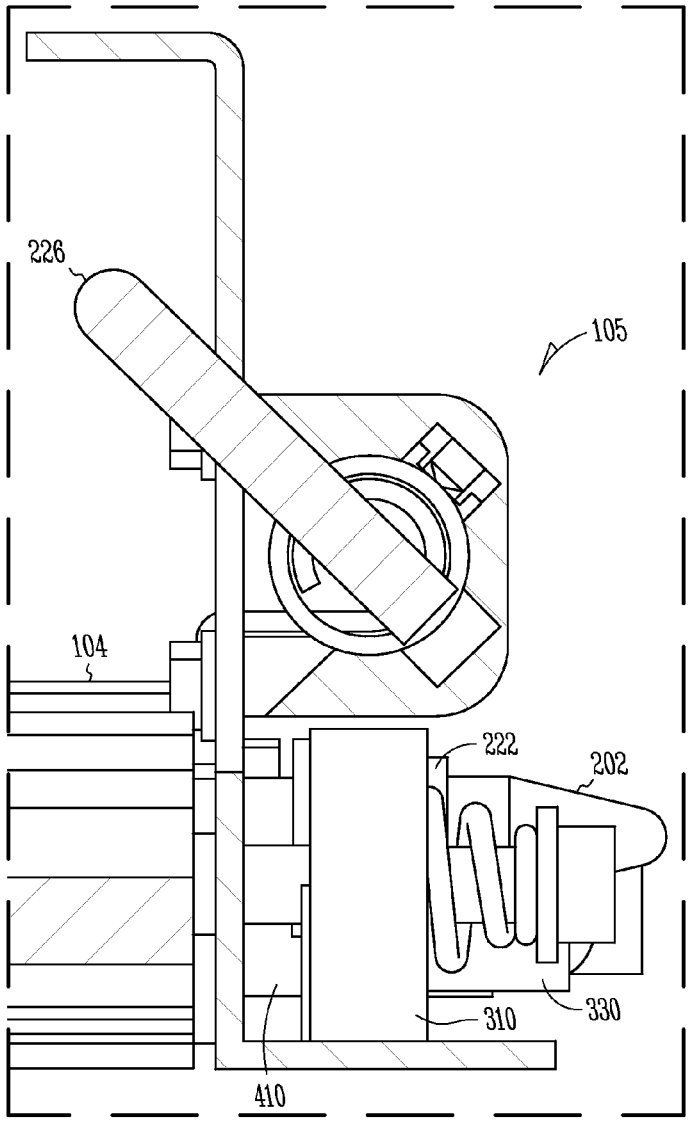
FIG. 5C shows a detail of FIG. 5B.

FIG. 5C shows a section view of base 104 pushed into assembly 105. Pin 202 has extended through guide hole receiver 222, and the electrical connector 330 on spring-loaded plate 310 is electrically mated to connector 410 on the base.

Figure 6A:
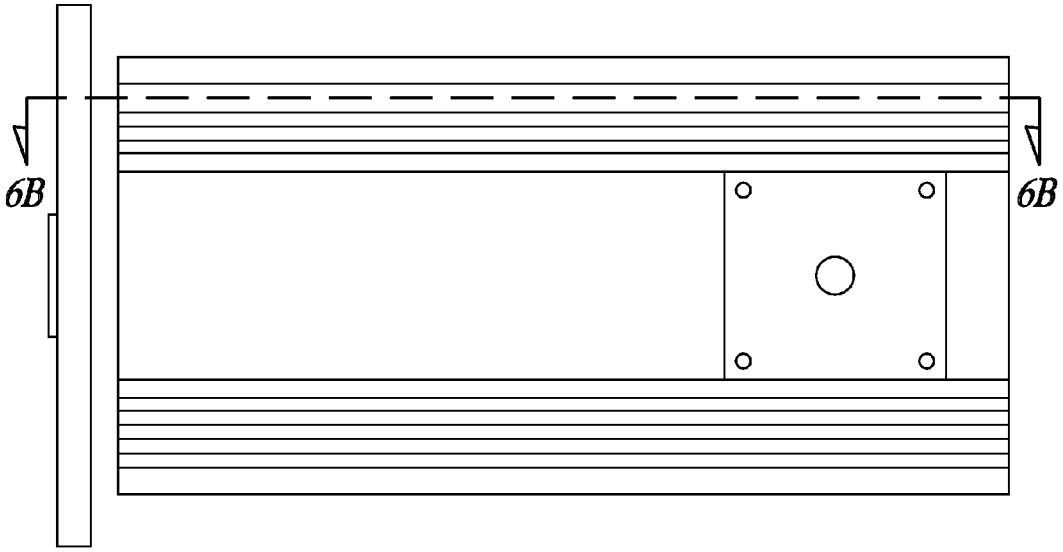
FIG. 6A shows a top view of the interconnection system of FIG. 1.
Figure 6B:
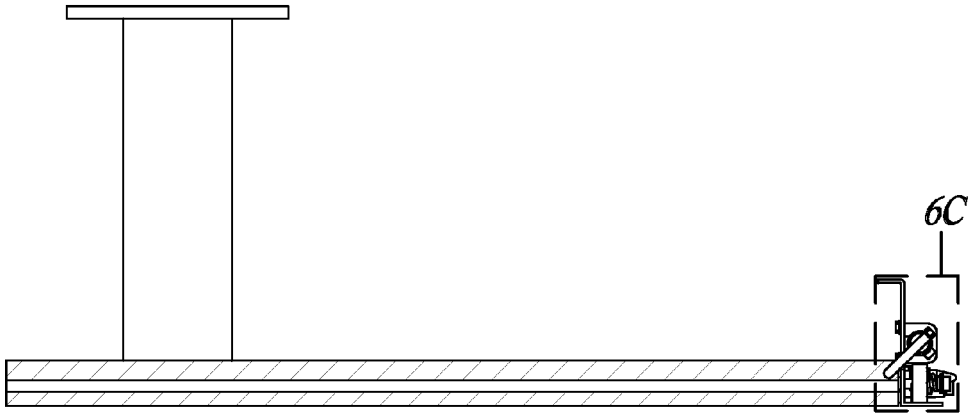
FIG. 6B shows a side section view of FIG. 6A.

FIG. 6A shows a top view of the system. FIG. 6B shows a section of FIG. 6A and FIG. 6C shows further details of connection assembly 105, in accordance with one embodiment.

Figure 6C:
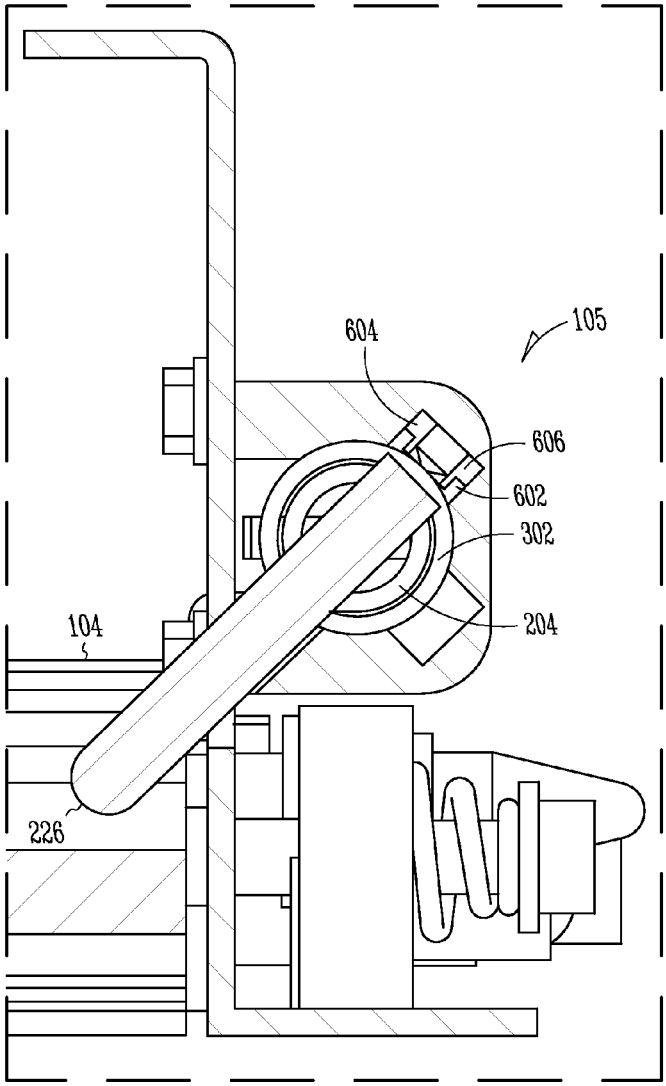
FIG. 6C shows a detail of FIG. 6B.

FIG. 6C shows a cross-section of base 104 coupled to connection assembly 105. Actuator 226 has been rotated downward to lock or latch cross-pin 204 within tubular locking member 302. An end 602 of actuator 226 pushes a spring-loaded pin 606 into a cut-out 604 in housing 320. When the actuator 226 is removed, pin 606 will be biased inward toward the center and hold member 302 in place. This in turn holds the cross-pin 204 and the sled in place. To release the sled, the actuator 226 is inserted until it pushes pin 606 back into cut-out 604 and then the actuator is rotated upward. Some embodiments include a second spring-loaded pin at the second cut-out located 90 degrees from cut-out 604.

In some embodiments, member 302 can be mounted such that its rotational center is offset from its geometric center. Thus, when it is rotated it will further pull in the cross-pin 204 to help seat the electrical connection, for example.

In some embodiments, the system provides for substantially simultaneous mechanical and electrical connection. The blind-mate system allows the electrical and mechanical connectors to be situated such that the connections happen substantially simultaneously and without undue adjustment by the installer.

To mechanically couple the chair to the machine, the base is slid towards the machine and latched to the machine using the rotary latching mechanism discussed above.

To electrically and mechanically connect the chair to the machine, the base is slid towards the machine and guided as discussed above. The base is then latched to the machine using one of the techniques described above or another latching system. The rotary latching mechanism provides a secure retention technique of the base and connector, while providing a stress-free electrical connection. This is important if somebody lifts the chair for example. In other words, the mechanical coupling holds the units together tightly enough that twisting one or the other does not effect the electrical connection. Also, the floating connection allows for mounting the base on either hard floors or carpeting.

To remove the base, for example, for maintenance reasons, the actuator is rotated and the electrical and mechanical connections are decoupled as the base is slid away from the machine.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A gaming system comprising:

a chair;

a base including a cross-pin and one or more guide pins, the one or more guide pins extending in a horizontal direction parallel with a length of the base;

a gaming machine that is couplable to the chair via the base; and a connection assembly for association with the gaming machine, the connection assembly including one or more float-mounted guide pin receivers configured to adaptively receive the one or more guide pins in a horizontal and a vertical direction, and a rotary locking mechanism including a removable actuator that is insertable into a rotatable tubular member for controlling a rotational position of the tubular member, the tubular member configured to receive the cross-pin of the base to latch the base to the gaming machine;

wherein the tubular member is rotatable from a first rotational position to a second rotational position to lock the cross-pin within the tubular member upon inserting the actuator into the tubular member and pushing a spring-loaded pin positioned adjacent to an end of the actuator into a pin-receiving cutout.

2. The system of claim 1, further comprising a first electrical connection included in the connector assembly or the gaming machine and a second electrical connector included in the base, the first electrical connector configured to mate with the second electrical connector.

3. The system of claim 2, wherein the electrical connector on the connector assembly or the gaming machine is float-mounted.

4. The system of claim 1, wherein the mechanical connector is positioned above and oriented parallel with a top planar surface of the base.

5. The system of claim 1, wherein the float-mounted guide pin receivers are spring-mounted on the gaming machine.

6. A gaming system comprising:

a chair;

a base having a leading end and a trailing end, the base including a cross-pin connector, extending horizontally outward from a central region of the leading end, and an electrical connector;

a gaming machine; and a connection assembly for association with the gaming machine, the connection assembly including an electrical connector, configured to mate with the electrical connector of the base, a front plate having a slot-like opening, and a relay locking mechanism including a removable actuator that is insertable into a rotatable tubular member for controlling a rotational position of the tubular member, the tubular member configured to mate with the cross-pin connector to latch the base to the gaming machine, wherein the cross-pin connector is sized, shaped and positioned to penetrate the slot-like opening prior to being received within and coupled, behind the opening, using the rotary locking mechanism.

7. The system of claim 6, wherein the electrical connector included in the connection assembly is float-mounted relative to the front plate, and wherein one or more guide pins included in the base are configured to mate with one or more float-mounted receivers mounted to the front plate.

8. The system of claim 6, wherein the electrical connector included in the connection assembly is mounted to a plate, which is spring-mounted to the front plate.

9. The system of claim 6, wherein one or more guide pin receivers are mounted to a spring-mounted plate.

10. The system of claim 6, wherein the electrical connector included in the base is rigidly connected to the base.

11. The system of claim 6, wherein the electrical and mechanical connections between the base and the connection assembly are configured to happen substantially simultaneously.

12. The system of claim 6, wherein the chair includes electronics and an electrical connection runs from the electronics through the base and towards the leading edge of the base.

13. An apparatus for use in a gaming system comprising:

a connection assembly for association with a gaming machine, the connection assembly including an electrical connector, float-mounted to a front plate, and a mechanical coupling member including a rotatable tubular member configured to receive a mating cross-pin of a chair base to latch the base to the gaming machine, and a removable actuator insertable into the tubular member for controlling a rotational position of the tubular member, wherein the rotatable tubular member of the connection assembly is configured such that the cross-pin is receivable within the tubular member by a horizontal movement of the base towards the gaming machine, and wherein the tubular member is rotatable from a first rotational position to a second rotational position to lock the cross-pin within the tubular member upon inserting the actuator into the rotatable tubular member and pushing a spring-loaded pin positioned adjacent to an end of the actuator into a pin-receiving cutout.

14. The apparatus of claim 13, wherein the electrical connector included in the gaming machine is mounted to a plate, which is spring-mounted to the front plate.

15. The system of claim 14, wherein the plate further includes one or more guide pin receivers to mate with one or more guide pins included in the chair base.

16. The apparatus of claim 13, wherein the connection assembly includes one or more float-mounted guide pin receivers, configured to adaptively receive a guide pin of the chair base in a horizontal and a vertical direction when the base is mounted to the assembly.

17. A method comprising:

sliding a chair base toward a gaming machine, the chair base having a leading edge and a tailing edge;

electrically coupling the chair base to the gaming machine via a floating connector on the gaming machine; and mechanically coupling the chair base to the gaming machine by receiving a pin member extending outward from a horizontal central region of the base leading edge into a rotatable tubular member recessed within the gaming machine, inserting an actuator into the tubular member, pushing a spring-loaded pin positioned adjacent to an end of the actuator into a pin-receiving cutout, and rotating the tubular member from a first rotational position to a second rotational position to lock the pin member within the to member.

18. The method of claim 17, wherein electrically coupling includes electrically coupling a speaker attached to the chair to the gaming machine.

19. The method of claim 17, wherein electrically coupling includes coupling a receptacle connector on the base to a plug connector on the gaming machine.

20. A gaming system comprising:

a gaming machine having an electrical connector, a front plate having a slot-like opening, and a rotary locking mechanical connector; and a chair having a base, the base having a mechanical connector configured to mate with the rotary locking mechanical connector of the gaming machine, and an electrical connector configured to mate with the electrical connector of the gaming machine, wherein the base electrical connector is exposed on a front end of the base and is located below a top planar surface of the base, wherein the mechanical connector on the base is sized, shaped and positioned to penetrate the slot-like opening of the front plate prior to being received within and coupled, behind the opening, using and the rotary locking mechanism of the gaming machine, and wherein the rotary locking mechanism includes a rotatable tubular member and the mechanical connector of the base includes a cross-pin, the tubular member being rotatable from a first rotational position to a second rotational position using an operably coupled actuator to enclose and lock the cross-pin within the tubular member.

* * * * *

UNITED STATES PATENT AND TRADEMARK OFFICE

CERTIFICATE OF CORRECTION

PATENT NO. : 8,029,369 B2
APPLICATION NO. : 11/569689
DATED : October 4, 2011
INVENTOR(S) : Brian Hahn It is certified that error appears in the above-identified patent and that said Letters Patent is hereby corrected as shown below:

On page 2, under "Other Publications", in column 2, line 9, delete "fiiled" and insert -- filed --, therefor.

In column 4, line 20, delete "about" and insert -- to about --, therefor.

In column 6, line 53, in Claim 6, delete "relay" and insert -- rotary --, therefor.

In column 7, line 39, in Claim 15, delete "system" and insert -- apparatus --, therefor.

In column 8, line 3, in Claim 17, delete "tailing" and insert -- trailing --, therefor.

In column 8, line 15, in Claim 17, delete "to" and insert -- tubular --, therefor.

In column 8, line 37, in Claim 20, delete "using and" and insert -- using --, therefor.

Signed and Sealed this
Thirty-first Day of January, 2012

David J. Kappos

David J. Kappos
*Director of the United States Patent and Trademark Office*